US006663767B1

(12) United States Patent
Berlowitz et al.

(10) Patent No.: US 6,663,767 B1
(45) Date of Patent: Dec. 16, 2003

(54) LOW SULFUR, LOW EMISSION BLENDS OF FISCHER-TROPSCH AND CONVENTIONAL DIESEL FUELS

(75) Inventors: Paul Joseph Berlowitz, Glen Gardner, NJ (US); Daniel Francis Ryan, Baton Rouge, LA (US); Robert Jay Wittenbrink, Kingwood, TX (US); Jack Wayne Johnson, Clinton, NJ (US); John Richard Bateman, Berkshire (GB)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/562,452

(22) Filed: May 2, 2000

(51) Int. Cl.[7] ..... C10L 1/08
(52) U.S. Cl. ..... 208/15; 44/300; 585/14
(58) Field of Search ..... 44/300; 585/14; 208/15

(56) References Cited

U.S. PATENT DOCUMENTS

| | | | | | |
|---|---|---|---|---|---|
| 5,324,335 | A | | 6/1994 | Benham et al. | 44/452 |
| 5,378,348 | A | * | 1/1995 | Davis et al. | 208/27 |
| 5,506,272 | A | | 4/1996 | Benham et al. | 518/700 |
| 5,689,031 | A | | 11/1997 | Berlowitz et al. | 585/734 |
| 5,723,716 | A | | 3/1998 | Brandes et al. | 585/734 |
| 5,770,542 | A | | 6/1998 | Brandes et al. | 502/527 |
| 5,792,339 | A | | 8/1998 | Russell | 208/15 |
| 5,807,413 | A | | 9/1998 | Wittenbrink et al. | 44/451 |
| 5,814,109 | A | * | 9/1998 | Cook et al. | 44/300 |
| 6,056,793 | A | * | 5/2000 | Suppes | 44/446 |
| 6,150,575 | A | * | 11/2000 | Angevine et al. | 585/14 |
| 6,162,956 | A | * | 12/2000 | Berlowitz et al. | 585/14 |
| 6,180,842 | B1 | * | 1/2001 | Berlowitz et al. | 585/1 |
| 6,265,629 | B1 | * | 7/2001 | Fava et al. | 585/14 |
| 6,274,029 | B1 | * | 8/2001 | Wittenbrink et al. | 208/15 |
| 6,296,757 | B1 | * | 10/2001 | Wittenbrink et al. | 208/15 |
| 6,309,432 | B1 | * | 10/2001 | Wittenbrink et al. | 44/36 |

FOREIGN PATENT DOCUMENTS

| | | | |
|---|---|---|---|
| EP | 0687289 B1 | 12/1998 | C10L/1/22 |
| WO | WO 00/20535 | 4/2000 | C10L/1/08 |

OTHER PUBLICATIONS

Jimell Erwin et al, Southwest Research Institute, "The Standing of Fischer–Tropsch Diesel in an Assay of Fuel Performance and Emissions", Nov. 26, 1991–Oct. 26, 1993, pp. 1015–1053, NREL SUB YZ–2–113215–1.
"Standard Specification for Diesel Fuel Oils", ASTM Designation: D 975–98b, pp. 1–18.

(List continued on next page.)

*Primary Examiner*—Ellen M. McAvoy
(74) *Attorney, Agent, or Firm*—Mark D. Martin

(57) ABSTRACT

A blended fuel, useful as a diesel fuel, wherein the fuel blend contains an undercut conventional diesel fuel, blended with a Fischer-Tropsch derived diesel fuel, such that the blend demonstrates better than expected emissions and a reduced sulfur content. In particular, the blend is an asymmetric diesel fuel blend comprising a Fischer-Tropsch derived hydrocarbon distillate having a T95 of at least 600° F., blended with a petroleum derived hydrocarbon distillate having an initial boiling point and a T95 no greater than 640° F.

30 Claims, 1 Drawing Sheet

OTHER PUBLICATIONS

"European Programme on Emissions, Fuels and Engine Technologies", ACEA, Europia, Executive Summary, Jul. 1995, pp. 1–12.

T. W. Ryan III et al, Southwest Research Institute, "Diesel Fuel Composition Effects on Ignition and Emissions", 932735, pp. 77–94.

K. B. Spreen et al, Southwest Research Institute, "Effects of Cetane Number, Aromatics, and Oxygenates on Emissions From a 1994 Heavy–Duty Diesel Engine With Exhaust Catalyst", 950250, pp. 238–254.

T. L. Ullman et al, Southwest Research Institute, "Effects of Cetane Number on Emissions From A Prototype 1998 Heavy–Duty Diesel Engine", 950251, pp. 255–271.

M. Signer et al, "European Programme on Emissions, Fuels and Engine Technologies (EPEFE)—Heavy Duty Diesel Study", 961074, pp. 564–579.

D. J. Rickeard et al, "European Programme on Emissions, Fuels and Engine Technologies (EPEFE)—Comparison of Light and Heavy Duty Diesel Studies", 961075, pp. 580–599.

M. Hublin et al, "European Programmes on Emissions, Fuels and Engine Technologies (EPEFE)—Light Duty Diesel Study", 961073, SAE Technical Paper Series, May 6–8, 1996, pp. 1–37.

* cited by examiner

LOW SULFUR, LOW EMISSION BLENDS OF FISCHER-TROPSCH AND CONVENTIONAL DIESEL FUELS

FIELD OF THE INVENTION

This invention relates to blends of Fischer-Tropsch derived fuels and conventional petroleum fuels. More particularly, this invention relates to a blended fuel, useful in a diesel engine which is low in sulfur and demonstrates better than predicted emissions characteristics.

BACKGROUND

A concern for future diesel fuels is the ability to produce higher quality and cleaner burning diesel fuels without extensive and expensive reprocessing. Typical factors detrimental to fuel quality are high sulfur, high density, high end boiling and T95 points, (the temperature at which most all the material has boiled off, leaving only 5% remaining in the distillation pot) high aromatic and polyaromatic contents. These factors have been shown to have a detrimental effect on emissions. For example, see the Coordinating Research Council (CRC) study on heavy duty diesels in the United States reported in SAE papers 932735, 950250 and 950251, and the European Programme on Emissions, Fuels and Engine Technologies (EPEFE) study on light and heavy duty diesels reported in SAE papers 961069, 961074 and 961075.

In contrast, emissions measurements on Fischer-Tropsch diesel fuels, which have virtually nil sulfur, aromatic and polyaromatic contents demonstrate favorable emissions characteristics. A report by the Southwest Research Institute (SwRI) entitled "The Standing of Fischer-Tropsch Diesel in an Assay of Fuel Performance and Emissions" by Jimell Erwin and Thomas W. Ryan, III, NREL (National Renewable Energy Laboratory) Subcontract YZ-2-113215, Oct. 1993, details the advantage of Fischer-Tropsch fuels for lowering emissions when used neat, that is, use of pure Fischer-Tropsch diesel fuels.

Presently, there remains a need to develop an economic, low sulfur distillate fuel blend useful as a diesel fuel which has lowered emissions after combustion and allows a greater portion of the distillate to be used as a high value premium product. In particular, sulfur levels, emissions of solid particulate matter (PM), and nitrogen oxides (NOx) are important due to current and proposed environmental regulations. While it has been disclosed that Fischer-Tropsch fuels can be blended with conventional fuels, see for example U.S. Pat. No. 5,689,031 herein incorporated by reference, the ability to further improve such blends with respect to emissions provides a distinct economic advantage.

The citations of the several SAE papers referenced herein are:

P. J. Zemroch, P. Schimmering, G. Sado, C. T. Gray and Hans-Martin Burghardt, "*European Programme on Emissions, Fuels and Engine Technologies-Statistical Design and Analysis Techniques*", SAE paper 961069.

M. Signer, P. Heinze, R. Mercogliano and J. J. Stein, "*European Programme on Emissions, Fuels and Engine Technologies-Heavy Duty Diesel Study*", SAE paper 961074.

D. J. Rickeard, R. Bonetto and M. Signer, ", "*European Programme on Emissions, Fuels and Engine Technologies-Comparison of Light and Heavy Duty Diesels*", SAE paper 961075.

K. B. Spreen, T. L. Ullman and R. L. Mason, "*Effects of Cetane Number, Aromatics and Oxygenates on Emissions from a* 1994 *Heavy-Duty Diesel Engine with Exhaust Catalyst*", SAE paper 950250.

K. B. Spreen, T. L. Ullman and R. L. Mason, "*Effects of Cetane Number on Emissions from a Prototype* 1998 *heavy Duty Diesel Engine*", SAE paper 950251.

Thomas Ryan III and Jimell Erwin, "*Diesel Fuel Composition Effect on Ignition and Emissions*", SAE paper 932735.

M. Hublin, P. G. Gadd, D. E. Hall, K. P. Schindler, "*European Programme on Emissions, Fuels and Engine Technologies-Light Duty Diesel Study*", SAE paper 961073.

SUMMARY OF THE INVENTION

According to an embodiment of this invention is provided a blended fuel, useful as a diesel fuel, wherein the fuel blend contains an undercut conventional diesel fuel, blended with a Fischer-Tropsch derived diesel fuel, such that the blend demonstrates better than expected emissions and a reduced sulfur content. In particular, the blend is an asymmetric diesel fuel blend comprising a Fischer-Tropsch derived hydrocarbon distillate having a T95 of at least 600° F. (316° C.), preferably at least 650° F. (343° C.), more preferably at least 700–750° F. (371° C.–399° C.), blended with a petroleum derived hydrocarbon distillate having an initial boiling point and a T95 no greater than 640° F. (378° C.), preferably a T95 no greater than 600° F. (316° C.) wherein the blend has a sulfur content of less than 500 wppm. The resultant diesel fuel blend is characterized by an initial boiling point ranging from at least 280° F.+ (138° C.+), preferably at least 300° F.+ (149° C.+), more preferably 320° F.+ (160° C.+) and a T95 up to about 700° F. (371° C.), preferably up to about 680° F. (360° C.), even more preferably up to about 660° F. (349° C.), still more preferably up to about 640° F. (378° C.) and contains:

Sulfur <500 wppm, preferably <150 wppm, more preferably <50 wppm, even more preferably <30 wppm, Polyaromatics <11 wt %, preferably <wt 5%, more preferably <1 wt %, Cetane number >50, preferably >55, more preferably >60, Density from about 0.79 to about 0.85 wherein the Fischer-Tropsch distillate comprises 5–90 vol. % of the blended diesel fuel, preferably 20–80 vol. %, more preferably 30–80 vol. %.

A typical diesel fuel boils in the range of about 320–700° F. However, sulfur levels generally increase with boiling point, i.e., heavier diesel derived from crude oil has a higher sulfur content than lighter diesel. See Jimell Erwin, Thomas W. Ryan, III, "*The Standing of Fischer-Tropsch Diesel in an Assay of Fuel Performance and Emissions*", NREL (National Renewable Energy Laboratory) Subcontract YZ-2-113215, October 1993. The blend of the invention provides a fuel having reduced sulfur levels and emissions levels lower than those predicted by standard correlations, e.g., European Program on Emissions Fuels and Engine Technologies, SAE Paper 961073, by eliminating the heavy end of the conventional diesel fuel and replacing the heavy end with a low sulfur Fischer-Tropsch derived diesel fuel boiling above the range of a normal diesel fuel. In addition to reducing sulfur levels, the diesel fuel blend of this invention outperforms predicted emissions levels, especially in emissions of nitrous oxides.

DETAILED DESCRIPTION OF THE INVENTION

Figure 1:
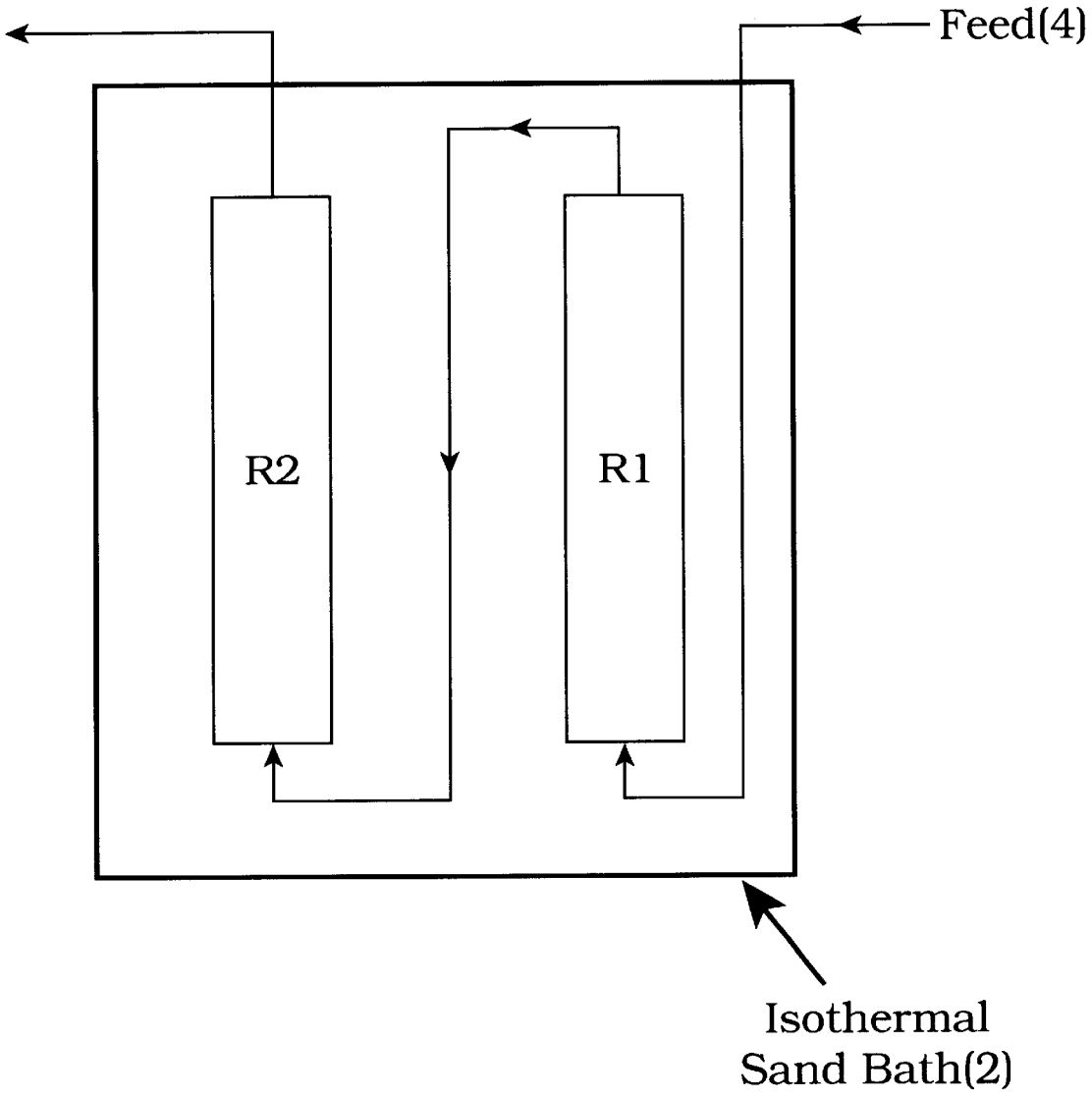
FIG. 1 is flow-scheme diagram of fixed bed reactors connected in series and contained within an isothermal sand bath for production of a blend stock for use in one embodiment of the present invention.

The Fischer-Tropsch process is well known to those skilled in the art, see for example, U.S. Pat. Nos. 5,348,982 and 5,545,674 herein incorporated by reference. Typically the Fischer-Tropsch process involves the reaction of a synthesis gas feed comprising hydrogen and carbon monoxide fed into a hydrocarbon synthesis reactor in the presence of a Fischer-Tropsch catalyst, generally a supported or unsupported Group VIII, non-noble metal e.g., Fe, Ni, Ru, Co and with or without a promoter e.g., ruthenium, rhenium and zirconium. These processes include fixed bed, fluid bed and slurry hydrocarbon synthesis. A preferred Fischer-Tropsch process is one that utilizes a non-shifting catalyst, such as cobalt or ruthenium or mixtures thereof, preferably cobalt, and preferably a promoted cobalt, the promoter being zirconium or rhenium, preferably rhenium. Such catalysts are well known and a preferred catalyst is described in U.S. Pat. No. 4,568,663 as well as European Patent 0 266 898. The synthesis gas feed used in the process comprises a mixture of $H_2$ and CO wherein $H_2$:CO are present in a ratio of at least about 1.7, preferably at least about 1.75, more preferably 1.75 to 2.5.

Regardless of the catalyst or conditions employed however, the high proportion of normal paraffins in the product produced by the Fischer-Tropsch process must be converted from waxy hydrocarbon feeds into more useable products, such as transportation fuels. Thus, conversion is accomplished primarily by hydrogen treatments involving hydrotreating, hydroisomerization, and hydrocracking in which a suitable fraction of the product is contacted with a suitable catalyst in the presence of hydrogen to isomerize the fraction by converting the molecular structure of at least a portion of the hydrocarbon material from normal paraffins to branched iso-paraffins to form the desired product, as is known to those skilled in the art.

Hydroisomerization and hydrocracking are well known processes for upgrading hydrocarbon synthesis products and their conditions can vary widely. Hydroisomerization is achieved by reacting the waxy feed with hydrogen in the presence of a suitable hydoisomerization catalyst. While many catalysts may be satisfactory for this step, some catalysts perform better than others and are preferred. For example, applicants preferred hydroisomerization catalyst comprises one or more Group VIII noble or non-noble metal components, and depending on the reaction conditions, one or more non-noble metals such as Co, Ni and Fe, which may or may not also include a Group VIB metal (e.g., Mo, W) oxide promoters, supported on an acidic metal oxide support to give the catalyst both a hydrogenation and dehydrogenation function for activating the hydrocarbons and an acid function for isomerization. However, noble metals reduce hydrogenolysis, particularly at lower temperatures and will therefore be preferred for some applications. Preferred noble metals are Pt and Pd. The catalyst may also contain a Group IB metal, such as copper, as a hydrogenolysis suppressant. The cracking and hydrogenating activity of the catalyst is determined by its specific composition. The metal Groups referred to herein are those found in the Sargent-Welch Periodic Table of the Elements, copyright 1968.

The acidic support is preferably an amorphous silica-alumina where the silica is present in amounts of less than about 30 wt %, preferably 5–30 wt %, more preferably 10–20 wt %. Additionally, the silica-alumina support may contain amounts of a binder for maintaining catalyst integrity during high temperature, high pressure processes. Typical binders include silica, alumina, Group IVA metal oxides, e.g., zirconia, titania, various types of clays, magnesia, etc., and mixtures of the foregoing, preferably alumina, silica, or zirconia, most preferably alumina. Binders, when present in the catalyst composition, make up about 5–50% by weight of the support, preferably 5–35% by weight, more preferably 20–30% by weight.

Characteristics of the support preferably include surface areas of 200–500 $m^2$/gm (BET method), preferably about 250–400 $m^2$/gm; and pore volume of less than 1 ml/gm as determined by water adsorption, preferably in the range of about 0.35 to 0.8 m/gm, e.g., 0. 57 ml/gm.

The metals may be incorporated onto the support by any suitable method, and the incipient wetness technique is preferred. Suitable metal solutions may be used, such as nickel nitrate, copper nitrate or other aqueous soluble salts. Preferably, the metals are co-impregnated onto the support allowing for intimate contact between the Group VIII metal and the Group IB metal, for example, the formation of bimetallic clusters. The impregnated support is then dried, e.g., over night at about 100°–150° C., followed by calcination in air at temperatures ranging from about 200°–550° C., preferably 350°–550° C., so that there is no excessive loss of surface area or pore volume.

Group VIII metal concentrations of less than about 15 wt % based on total weight of catalyst, preferably about 1–12 wt %, more preferably about 1–10 wt % can be employed. The Group IB metal is usually present in lesser amounts and may range from about a 1:2 to about a 1:20 ratio respecting the Group VIII metal.

Nevertheless, the Fischer-Tropsch derived distillates that may be used in the blends of this invention include distillates recovered from the Fischer-Tropsch reactor, whether or not hydrotreated, i.e., hydrogen treatments in the presence of a suitable catalyst, including but not limited to, one or more of hydrotreating, hydroisomerization, dewaxing and hydrocracking, as well as distillates recovered from fractionating the wax containing product from the Fischer-Tropsch reactor, whether or not hydrotreated. However, a preferred Fischer-Tropsch derived distillate comprises a distillate fraction derived from any hydroisomerized wax containing Fischer-Tropsch feed utilizing any suitable hydroisomerization catalyst under standard hydroisomerization conditions commonly known in the art.

Preferably, the Fischer-Tropsch derived hydrocarbon distillate has a T95 of at least 600° F., more preferably the Fischer-Tropsch derived distillate has an initial boiling point of at least 300° F. and a T95 of at least 650° F., even more preferably an initial boiling point of at least 320° F. and a T95 of at least 700–750° F. and contains:

Sulfur, nitrogen <10 wppm, preferably <5 wppm, more preferably <1 wppm,

Aromatics <1 wt %, preferably <0.1 wt %, more preferably undetectable by ASTM D-5292

Cetane number ≧65, preferably ≧70,

The conventional petroleum derived fuel may be any conventional low sulfur diesel fuel, i.e., low sulfur No. 2-D diesel fuel as specified in ASTM D-975-98b, which may be derived from crude oil by conventional petroleum processing or from slack wax or from other feed stocks, and is characterized as an undercut diesel fuel, that is, a fuel that has a final cut point below the boiling range of a typical diesel fuel. Preferably, the undercut conventional blend stock of this invention has a T95 no greater than 640° F., preferably a T95 below 600° F. However, because sulfur level increases with boiling point, cut points may be varied, i.e., decreased, to achieve desired sulfur levels in the conventional blend stock. In this way, sulfur levels of the final blend may be controlled based on the final cut point of the conventional diesel blend stock.

A better illustration of the preferred embodiments of this invention may be had by the following comparisons and examples.

A diesel fuel blend was prepared by combining an undercut conventional low sulfur No. 2-D diesel fuel (ASTM D975-98b) with a Fischer-Tropsch derived diesel fuel blend stock.

The Fischer-Tropsch distillate blend stock was prepared as follows:

A 300° F.+ Fischer-Tropsch derived wax containing feed was run through two 0.5 in. up-flow fixed bed reactors, R1 and R2, connected in series and contained within an isothermal sand bath where the product of the first reactor (R1) was fed directly into the reaction zone of the second reactor (R2).

R1 contained 80 cc (44.7 gms) of a commercially available hydroisomerization catalyst comprising 0.5 wt % Pd on a silica-alumina support containing nominally 20 wt % alumina/80 wt% silica and 30 wt% alumina binder. R2 contained a catalyst blend containing 29 cc (16.2 gms) of a commercially available dewaxing catalyst comprising 0.5 wt % Pt on an extrudate containing Theta-1 zeolite (TON) and 51 cc (27.5 gms) of the hydroisomerization catalyst contained in R1. The extrudate was crushed and the −8, +20 mesh used to load a portion of the fixed bed reactor. There was no treatment or interstage stripping of the hydroisomerized product of R1 prior to feeding into R2.

The 300° F.+ wax feed was run through R1 running at conditions that result in about 50% conversion of the 700° F.+ material to 700° F.− and dewaxing was run through R2 to achieve a cloud point less than −20° C. The isothermal reactor conditions were as follows: 715 psig, 1650 SCF/Bbl hydrogen treat rate at 0.854 LHSV and a temperature of approximately 606° F.

Product distribution from the process detailed above is shown in Table 1 below and the boiling point cuts used in the Fischer-Tropsch blend stock are indicated as Fuel 1. The feed was obtained by reacting hydrogen and CO over a Fischer-Tropsch catalyst comprising cobalt and rhenium on a titania support. In particular, Fuel 1 comprised a 300–800° F. Fischer-Tropsch derived hydrocarbon distillate fraction.

TABLE 1

| BOILING RANGE | YIELD, WT % | FUEL 1 |
|---|---|---|
| IBP–280° F. | 10.492 | No |
| 280–300° F. | 2.744 | No |
| 300–700° F. | 53.599 | Yes |
| 700–800° F. | 10.016 | Yes |
| 800° F.+ | 23.149 | No |

By virtue of using the Fischer-Tropsch process, the Fischer-Tropsch derived distillate has essentially nil sulfur and nitrogen. Further, the process does not make aromatics and polyaromatics, or as usually operated, virtually no aromatics are produced. Some olefins and oxygenates may be produced since one of the pathways for the production of paraffins is through an olefinic intermediate. Preferably, olefin concentration in the Fischer-Tropsch derived distillate is less than 10 vol %, more preferably less than 5 vol %, even more preferably less than 1 vol % (ASTM D-2710). Nevertheless, olefin and oxygenate concentration are relatively low, and essentially nil after hydrotreatment.

The undercut conventional diesel fuel was a U.S. No. 2-D low sulfur diesel fuel (ASTM D975-98b). In particular, the conventional diesel fuel comprised an undercut diesel fuel which has a nominal boiling range of about 320–640° F. and is indicated as Fuel 2. Sulfur levels listed in Table 2 were determined using ASTM D-2622.

TABLE 2

| BOILING RANGE | YIELD, WT % | FUEL 2 | Sulfur, wppm |
|---|---|---|---|
| IBP–600° F. | 61.43 | Yes | 22 |
| 600–625° F. | 11.48 | Yes | 238 |
| 625–640° F. | 6.03 | Yes | 685 |
| 640–650° F. | 3.81 | No | 1054 |
| 650–660° F. | 4.44 | No | 1632 |
| 660–675° F. | 9.69 | No | 1834 |

The entire conventional diesel (IBP-675° F.) qualifies as a low sulfur diesel, i.e., the sulfur levels are <0.05% of the total fuel by weight, as designated in ASTM D975-98b and contains 417 wppm of sulfur, whereas the undercut diesel (IBP-640° F.), Fuel 2, contains only 104 wppm. Thus, as illustrated from the fractions contained in Table 2, sulfur level increases with boiling range.

A 50/50 blend of the heavy Fischer-Tropsch diesel (Fuel 1) and the undercut conventional diesel (Fuel 2) was prepared for engine testing and is indicated as Fuel 3.

For emissions testing, the combined fuel blend was compared with two conventional petroleum diesel fuels referred to hereafter as Fuel 4 and Fuel 5. Fuel 4 was a U.S. No 2-D low sulfur diesel fuel (ASTM D975-98b) and Fuel 5 was a European Low Sulfur Automotive diesel (LSADO). Table 3 below provides a comparison of the relevant characteristics for Fuels 3–5.

TABLE 3

| PROPERTY | FUEL 3 | FUEL 4 | FUEL 5 |
|---|---|---|---|
| Density (IP-365) | .8090 | .846 | .854 |
| Sulfur, % (RD 86/10) | <0.01% | 0.04% | 0.05% |
| IBP, ° C. (ASTM D-86) | 179 | 197 | 184 |
| T50, ° C. (ASTM D-86) | 280 | 294 | 288 |
| T95, ° C. (ASTM D-86) | 355 | 339 | 345 |
| Cetane (ASTM D-613) | 61.5 | 53.0 | 50.1 |
| Aromatics, total % (IP-391) | 14.6 | 27.9 | 26.7 |
| Polyaromatics, % (IP-391) | 0.8 | 7.1 | 6.4 |
| Cloud Point, ° C. (ASTM D-5771) | −19 | −6 | −5 |
| CFPP, ° C. (IP-309) | −26 | −7 | −18 |

Each standard analytical technique used to determine the components of Fuels 3–5 is shown in parentheses. Table 3 illustrates that the blend of the invention has significantly lower sulfur levels as compared to each of the conventional fuels.

ENGINE TESTING

For comparison, the blended diesel fuel of the invention (Fuel 3) was compared with the conventional petroleum fuels. The fuels were evaluated with a Peugeot 405 Indirect Injection (IDI) light duty diesel engine. Regulated emissions were measured during hot-start transient cycles and emissions of hydrocarbons (HC), carbon monoxide (CO), nitrous oxide (NOx) and particulate matter (PM) were measured. The results are summarized in Table 4 below. Test data is represented as the absolute value in gm/Hp-hr which is followed by the percent change for each emission value verses the base, Fuel 5; a conventional petroleum diesel fuel. All fuels were run through the combined Urban Drive Cycle and Extra Urban Drive Cycle (commonly known as ECE-EUDC respectively) hot and cold test protocols in duplicate in a randomized design.

The light duty European test cycle is performed in two parts:

ECE: this urban cycle represents inner city driving conditions after a cold start with a maximum speed of 50 km/h, and EUDC: the extra-urban driving cycle is typical of suburban and open road driving behavior and includes speeds up to 120 km/h. The data is based on the combined emissions of the ECE and EUDC cycles expressed in g/km. See SAE Papers 961073 and 961068.

Fuel 5 was used as the reference and therefore run in triplicate; all other fuels were run in duplicate. The data represents the average values from the combination of the ECE-EUDC test procedures ("combined ECE-EUDC" reporting method).

TABLE 4

| | HC | Delta | NOx | Delta | CO | Delta | PM | Delta |
|---|---|---|---|---|---|---|---|---|
| Fuel 3 | 0.05 | −55.8% | 0.58 | −13.1% | 0.43 | −41.8% | 0.045 | −41.3% |
| Fuel 4 | 0.103 | −12.5% | 0.644 | −3.4% | 0.650 | −11.6% | 0.076 | −1.5% |
| Fuel 5 | 0.118 | basis | 0.669 | basis | 0.736 | basis | 0.077 | basis |

The data revealed significantly lower emissions produced from applicants' diesel fuel blend, Fuel 3, than observed with either of the conventional diesel fuels (Fuels 4 and 5). In particular, applicants blend, Fuel 3 produced emissions with a 55.8% decrease in hydrocarbons, 41.8% decrease in carbon monoxide, 13.1% decrease in nitrogen oxides and 41.3% decrease in particulate matter as compared to the base conventional diesel fuel. However, a closer review of the data shows that the fuels of this invention have a substantial advantage in particulates and nitrogen oxides emissions above that which would be expected. See SAE 961074 and 961075. In this regard, it is well known in the art that the most critical emissions parameter for a diesel fuel is the PM-NOx trade-off, i.e., there is a known inverse relationship between particulate matter and NOx. See SAE 961074 and 961075. Thus, in regard to emissions, decreasing one variable will normally result in increasing the other variable.

Table 5 below details the predicted changes for light duty (i.e., passenger car) diesel engines according to the well recognized European Program on Emissions, Fuels and Engine Technologies (EPEFE) study in Europe undertaken by the government, auto and oil companies to define the relationship between fuel properties and emissions based on variables in density, cetane number and T95; see SAE Paper 961073, Tables 3 through 6. The left hand column indicates the two pollutants (particulate matter and nitrogen oxides) along with the changes in absolute emissions in g/Hp-hr and percent change (% increase(positive) or % decrease (negative)) for each of the four fuel characteristics shown at the top of the columns. The emission change (in g/Hp-hr and percent) is based on a deviation of one of the four fuel characteristics as shown in parenthesis. For example, if the T95 was lowered by 55° C., the particulate emissions would decrease by 6.9% while the NOx would increase by 4.6%.

TABLE 5

| | Density (−0.027) | Polyaromatics (−7%) | Cetane (+8 numbers) | T95 (−55C) |
|---|---|---|---|---|
| Particulate | | | | |
| g/Hp-hr | −0.012 | −0.003 | 0.003 | −0.004 |
| % | −19.4% | −5.2% | 5.2% | −6.9% |
| NOx | | | | |
| g/Hp-hr | 0.008 | −0.019 | −0.001 | 0.026 |
| % | 1.4% | −3.4% | −0.2% | 4.6% |

Table 6 below was produced by combining the published results of Table 5, with the properties measured in Table 3 and the emissions results of Table 4. The resulting test data indicates the expected change in emissions as projected by the EPEFE equations versus the actual changes measured during emissions testing on each of the fuels listed in Table 5. Again, all results are referenced to Fuel 4 as the base fuel.

TABLE 6

| Pollutant | | Fuel 4 vs. 5 | Fuel 3 vs. 5 |
|---|---|---|---|
| Particulate | Projected | −3.9% | −27.7% |
| | Actual | −1.5% | −43.1% |
| NOx | Projected | 1.2% | 1.4% |
| | Actual | −3.4% | −13.1% |

Fuel 4, the conventional fuel, shows very close agreement with the predictions differing by only a slight amount with particulate emissions 2.4% (¯3.9%–¯1.5%) worse than expected and NOx 4.6% (1.2%–¯3.4%) better than expected. For Fuel 3, the contrast from Fuel 5, the base fuel, is quite different and unexpected. In fact, applicants' diesel fuel blend exceeded the performance predicted for particulate emissions (55.6% above projection [(¯43.1%–¯27.7%)/.277]) while at the same time dramatically decreasing NOx emissions(1036% above projection [(1.4%–¯13.1%)/.014). According to these projections, an improvement in particulate emissions is expected for Fuel 3 and the above data not only bears this prediction out but exceeds it. In addition, the EPEFE predictions predict a slight increase in NOx. However, in contrast to this prediction, the data reveals that applicants' diesel fuels resulted in a substantial reduction in the NOx emissions above the predicted value. Thus, applicants diesel fuels simultaneously result in both large NOx and particulate emissions reductions. Such results are unexpected and directly contradictory to the well recognized predictions.

In the claims hereinafter, sulfur is to be measured by x-ray fluorescence, for example as described in ASTM D-2622; cetane is to be determined using ASTM D-613; density is to be measured by D-4052; and T95 is to be determined by ASTM D-86.

What is claimed is:

1. A diesel fuel blend comprising a Fischer-Tropsch derived hydrocarbon distillate having a T95 of at least 600° F., and a petroleum derived hydrocarbon distillate having a T95 no greater than 640° F.

wherein the blend has a sulfur content less than 500 wppm.

2. The fuel blend of claim 1 wherein the blend has an initial boiling point of at least 280° F. and a T95 below about 700° F.

3. The fuel blend of claim 1 wherein the blend has an initial boiling point of at least 300° F. and a T95 below about 680° F.

4. The fuel blend of claim 1 wherein the blend has an initial boiling point of at least 320° F. and a T95 below about 640° F.

5. The fuel blend of claim 1 wherein the Fischer-Tropsch derived hydrocarbon distillate has an initial boiling point of at least 320° F. and a T95 of at least 700° F.

6. The fuel blend of claim 1 wherein the petroleum derived hydrocarbon has a T95 below 600° F.

7. The fuel blend of claim 1 wherein the blend has a sulfur content of less than 150 wppm.

8. The fuel blend of claim 1 wherein the blend has a sulfur content of less than 50 wppm.

9. The fuel blend of claim 1 wherein the blend has a sulfur content of less than 30 wppm.

10. The fuel blend of claim 1 wherein the Fischer-Tropsch distillate comprises 5–90 vol. % of the blend and the petroleum distillate comprises 90–5 vol. % of the blend.

11. The fuel blend of claim 1 wherein the Fischer-Tropsch distillate comprises 20–80 vol. % of the blend and the petroleum distillate comprises 80–20 vol. % of the blend.

12. The fuel blend of claim 1 wherein the Fischer-Tropsch distillate comprises 30–80 vol. % of the blend and the petroleum distillate comprises 80–30 vol. % of the blend.

13. The fuel blend of claim 1 wherein the blend contains less than or equal to mis wt. % polyaromatics and a cetane number of at least 50.

14. The fuel blend of claim 13 wherein the blend contains less than or equal to 5 wt. % polyaromatics.

15. The fuel blend of claim 14 wherein the blend contains less than or equal to 1 wt. % polyaromatics.

16. The fuel blend of claim 13 wherein the blend has a density ranging from about 0.79 to about 0.85.

17. A method of producing a low sulfur fuel useful as a diesel fuel with low emissions after combustion from a petroleum derived hydrocarbon distillate having a T95 no greater than 640° F., comprising blending said petroleum distillate with a Fischer-Tropsch derived hydrocarbon distillate having a T95 of at least 600° F., wherein the Fischer-Tropsch distillate comprises 10–90 vol. % of the blend and the blend has a sulfur content of less than 500 wppm.

18. The method of claim 17 wherein the blend has a sulfur content of less than 150 wppm.

19. The method of claim 18 wherein the blend has a sulfur content of less than 50 wppm.

20. The method of claim 19 wherein the blend has a sulfur content of less than 30 wppm.

21. The method of claim 17 wherein the blend has an initial boiling point of at least 280° F. and a T95 below about 700° F.

22. The method of claim 17 wherein the blend has an initial boiling point of at least 300° F. and a T95 below about 680° F.

23. The method of claim 17 wherein the blend has an initial boiling point of at least 320° F. and a T95 below about 640° F.

24. The method of claim 17 wherein the Fischer-Tropsch derived hydrocarbon distillate has an initial boiling point of at least 320° F. and a T95 of at least 700° F.

25. The method of claim 17 wherein the Fischer-Tropsch distillate comprises 5–90 vol. % of the blend and the petroleum distillate comprises 90–5 vol. % of the blend.

26. The method of claim 17 wherein the Fischer-Tropsch distillate comprises 20–80 vol. % of the blend and the petroleum distillate comprises 80–20 vol. % of the blend.

27. The method of claim 17 wherein the Fischer-Tropsch distillate comprises 30–80 vol. % of the blend and the petroleum distillate comprises 80–30 vol. % of the blend.

28. The method of claim 17 wherein the blend contains less than or equal to 11 wt. % polyaromatics and a cetane number of at least 50.

29. The method of claim 28 wherein the blend contains less than or equal to 5 wt. % polyaromatics.

30. The method of claim 29 wherein the blend contains less than or equal to 1 wt. % polyaromatics.

* * * * *